US010087946B2

(12) United States Patent
Wylie

(10) Patent No.: US 10,087,946 B2
(45) Date of Patent: Oct. 2, 2018

(54) CENTRIFUGAL PUMPS HAVING ANTI-AIR-LOCKING FEATURES

(71) Applicant: Brunswick Corporation, Lake Forest, IL (US)

(72) Inventor: James S. Wylie, Ballymena (GB)

(73) Assignee: Brunswick Corporation, Mettawa, IL (US)

( * ) Notice: Subject to any disclaimer, the term of this patent is extended or adjusted under 35 U.S.C. 154(b) by 338 days.

(21) Appl. No.: 15/019,047

(22) Filed: Feb. 9, 2016

(65) Prior Publication Data

US 2017/0227015 A1 Aug. 10, 2017

(51) Int. Cl.

| | |
|---|---|
| ***F04D 29/22*** | (2006.01) |
| ***F04D 1/00*** | (2006.01) |
| ***F04D 17/08*** | (2006.01) |
| ***F04D 29/28*** | (2006.01) |
| ***F04D 29/42*** | (2006.01) |
| ***F04D 9/00*** | (2006.01) |
| ***F04D 13/08*** | (2006.01) |

(52) U.S. Cl.

CPC ..... *F04D 29/2261* (2013.01); *F04D 1/00* (2013.01); *F04D 9/002* (2013.01); *F04D 13/086* (2013.01); *F04D 17/08* (2013.01); *F04D 29/2255* (2013.01); *F04D 29/2288* (2013.01); *F04D 29/288* (2013.01); *F04D 29/4233* (2013.01); *F04D 29/4293* (2013.01)

(58) Field of Classification Search

CPC ..... F04D 1/00; F04D 9/002; F04D 13/086; F04D 17/08; F04D 29/2255; F04D 29/2261; F04D 29/288; F04D 29/4233; F04D 29/4293; F04D 29/2288

See application file for complete search history.

(56) References Cited

U.S. PATENT DOCUMENTS

| | | | | |
|---|---|---|---|---|
| 2,379,133 A | | 6/1945 | Curtis | |
| RE22,739 E | | 4/1946 | Curtis | |
| 2,766,697 A | * | 10/1956 | Judd | F04D 29/2216 415/143 |
| 3,560,106 A | | 2/1971 | Sahlstrom | |
| 3,692,422 A | * | 9/1972 | Girardier | F04D 7/045 415/121.1 |
| 3,707,334 A | | 12/1972 | Ohlsson et al. | |
| 3,948,450 A | | 4/1976 | Erlitz | |
| 4,402,648 A | | 9/1983 | Kretschmer | |
| 4,640,666 A | | 2/1987 | Sodergard | |

(Continued)

OTHER PUBLICATIONS

GB Search Report, Application No. GB1702067.8, dated Jul. 14, 2017.

*Primary Examiner* — Igor Kershteyn

(74) *Attorney, Agent, or Firm* — Andrus Intellectual Property Law, LLP

(57) ABSTRACT

A centrifugal pump for pumping fluid includes a volute having an upstream inlet that receives the fluid and a downstream outlet that discharges the fluid. An impeller is disposed in the volute and comprises a plurality of impeller vanes. The impeller is configured to rotate about an axis of rotation so that the plurality of impeller vanes accelerates the fluid radially outwardly from the upstream inlet to the downstream outlet. The impeller is further configured to discourage air-lock of the centrifugal pump by expelling air away from the upstream inlet as the impeller rotates about the axis of rotation.

19 Claims, 5 Drawing Sheets

(56) References Cited

U.S. PATENT DOCUMENTS

| | | | | |
|---|---|---|---|---|
| 4,718,837 | A | 1/1988 | Frazzell | |
| 4,776,820 | A | 10/1988 | Mapes | |
| 4,940,402 | A | 7/1990 | McCormick | |
| 4,981,413 | A * | 1/1991 | Elonen | F04D 7/045 415/115 |
| 5,039,320 | A * | 8/1991 | Hoglund | D21D 5/26 415/143 |
| 5,114,310 | A * | 5/1992 | Haavik | F04C 19/00 415/143 |
| 5,413,460 | A * | 5/1995 | Wilson | F04D 7/04 415/169.1 |
| 5,503,521 | A * | 4/1996 | Capon | F04D 29/20 415/121.1 |
| 6,276,824 | B1 * | 8/2001 | De Jager | F04D 7/045 366/195 |
| 6,969,018 | B2 | 11/2005 | Ibanez et al. | |
| 8,662,862 | B2 * | 3/2014 | Muhs | B01D 21/0012 417/200 |

* cited by examiner

CENTRIFUGAL PUMPS HAVING ANTI-AIR-LOCKING FEATURES

FIELD

The present disclosure relates to pumps and more particularly to centrifugal pumps that can be used, for example, as a marine bilge pump.

BACKGROUND

Conventional marine bilge pumps typically have restricted downstream outlets that can be fitted with non-return valves. These pumps typically are prone to air-lock. To overcome this problem, it is known in the art to drill a small hole at the pump outlet, to thereby allow the air to escape. One such pump is disclosed in U.S. Pat. No. 3,707,344, which is incorporated herein by reference in entirety. U.S. Pat. No. 3,707,344 discloses a water pump such as for use with a commercial ice maker wherein the pump is normally submerged but the operation of which is controlled in response to a condition of the system independent of the water level at the pump, whereby air bubbles may form at the pump inlet due to a low level of water upon initiation of the pump operation. A breakup means is mounted on the impeller of the pump to project through the inlet to the pump for breaking up air bubbles that so form. The breakup means may comprise a pin member formed integrally with the impeller.

The following U.S. Patents disclose state of the art and are also incorporated herein by reference, in entirety:

U.S. Pat. No. 4,718,837 discloses a marine drive water pump impeller provided for a marine rotary vane positive displacement water pump. A filament wound annular drive hub is cured with resin polymer. A rubber annular base having a plurality of flexible radial vanes is molded in place around the drive hub. The resin polymer and the rubber are compatible and enable substantial bond strength there between. The hub is wound in the circumferential hoop direction, providing substantial hub strength.

U.S. Pat. No. 4,776,820 discloses a pump mechanism that is continuously operable by the engine of an outboard motor for discharging water that collects by seepage or leakage into the engine cowl. The pump mechanism includes an inlet conduit having an inlet end positioned closely adjacent to the bottom of an inclined channel formed in the lower section of the engine cowl, and an outlet conduit having an outlet end positioned exteriorly of the cowl.

U.S. Pat. No. 4,940,402 discloses in a rotary vane positive displacement pump, a pump impeller that has weights at the outer tips of the vanes of greater mass per unit volume than the vanes and increasing outward centrifugal force urging engagement of the outer tips against the pump housing sidewall.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a centrifugal pump for pumping fluid includes a volute having an upstream inlet that receives the fluid and a downstream outlet that discharges the fluid. An impeller is disposed in the volute. The impeller comprises a plurality of impeller vanes and is configured to rotate about an axis of rotation so that the plurality of impeller vanes accelerates the fluid radially outwardly from the upstream inlet to the downstream outlet. The impeller is uniquely configured to discourage air-lock of the centrifugal pump by expelling air away from the upstream inlet as the impeller rotates about the axis of rotation.

In certain examples, the plurality of vanes protrudes axially outwardly from the volute through the upstream inlet so that rotation of the impeller causes the plurality of vanes to expel air that collects in the volute at the upstream inlet. The volute comprises an inlet surface through which the upstream inlet is formed. A plurality of ridges radially extends with respect to the upstream inlet and the axis of rotation. The upstream inlet has a perimeter and the ridges in the plurality of ridges are spaced apart around the perimeter.

In certain examples, the impeller comprises a base that radially extends with respect to the axis of rotation from an outer perimeter towards the axis of rotation. Each vane in the plurality of vanes comprises a spiral ridge that curves radially inwardly towards the axis of rotation to a radially innermost end of the spiral ridge. Each spiral ridge comprises axially extending sidewalls and a top surface that extends along a length of the spiral ridge. The inlet comprises an inner perimeter and the top surface of the spiral ridge is spaced radially inwardly from and faces the inner perimeter a distance sufficient to discourage the air-lock from occurring.

BRIEF DESCRIPTION OF THE DRAWINGS

The present disclosure is described with reference to the following figures. The same numbers are used throughout the figures to reference like features and like components.

DETAILED DESCRIPTION OF THE DRAWINGS

As mentioned herein above, conventional marine bilge pumps typically have restricted downstream outlets that can be fitted with non-return valves. These pumps typically are prone to air-lock. To overcome this problem, it is known in the art to drill a small hole at the pump outlet to thereby allow the air, and eventually fluid, to escape. However, through research and experimentation, the present inventor has determined that these traditional bilge pumps tend to leak fluid at the small hole and can thus appear to the operator to be defective. The present inventor has realized that this is disadvantageous.

The present disclosure is a result of the present inventor's research and development efforts to overcome this problem. More particularly, the present inventor has endeavored to provide centrifugal pumps that are suitable for bilge pump operation in a marine environment and that avoid air lock and yet do not leak fluid at the outlet and thus do not appear to the operator to be defective.

Figure 4:
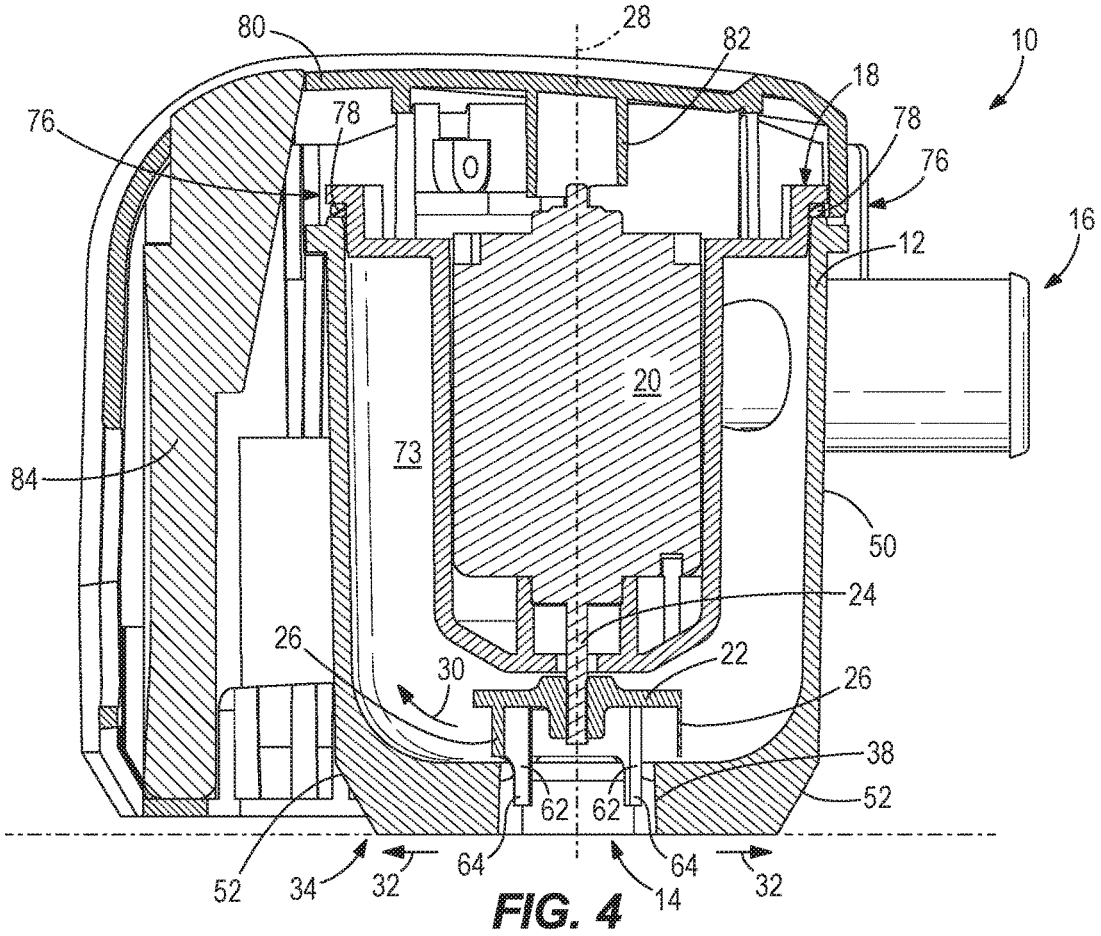
FIG. 4 is a view of section 4-4, taken in FIG. 2.
Figure 5:
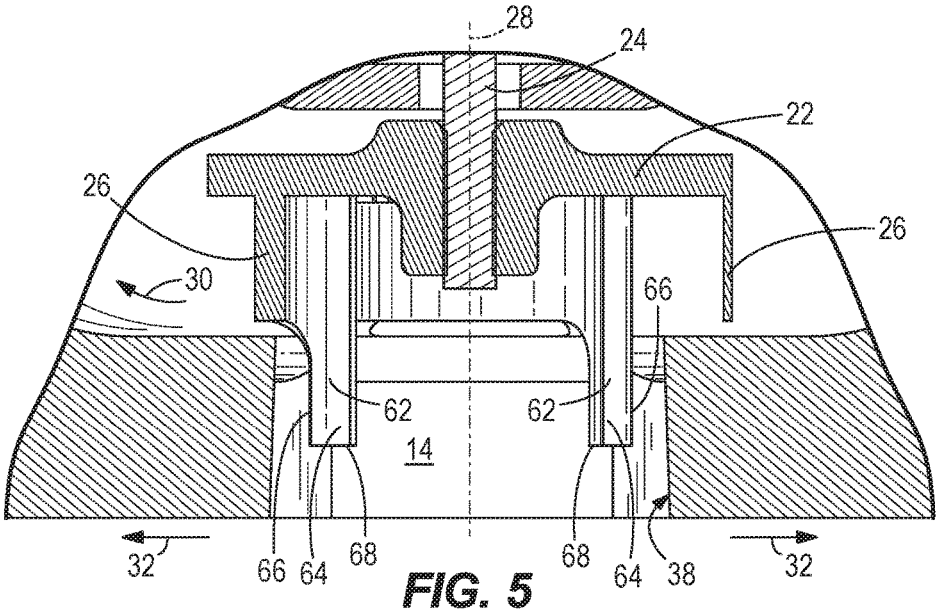
FIG. 5 is a detailed view of a portion FIG. 4.

FIGS. 1-5 depict one example of a centrifugal pump 10 for pumping fluid, for example from inside a bilge of a marine vessel. Referring initially to FIGS. 4 and 5, the centrifugal pump 10 includes a volute 12 having an upstream inlet 14 that receives the fluid to be pumped and a downstream outlet 16 that discharges the fluid. The centrifugal pump 10 also includes a motor housing 18 on the volute 12. The appearance (e.g. shape and size) of the volute 12 and/or motor housing 18 can vary from that which is shown and described. The motor housing 18 retains a motor 20, which in this example is an electric motor. The type of motor 20 can vary from that which is shown and described. Operation of the motor 20 drives an impeller 22 into rotation via a spindle shaft 24. The impeller 22 is connected to the spindle shaft 24 such that it is configured to rotate with rotation of the spindle shaft 24. Operation of the motor 20 causes rotation of the spindle shaft 24, which in turn causes rotation of the impeller 22.

The impeller 22 is disposed at least partially in the volute 12 and includes a plurality of impeller vanes 26. The impeller 22 is configured to rotate about an axis of rotation 28 so that the plurality of impeller vanes 26 accelerates fluid radially outwardly, as shown at arrow 30, from the upstream inlet 14 towards the downstream outlet 16. The impeller 22, including the plurality of impeller vanes 26, is further uniquely configured to discourage air-lock of the centrifugal pump 10 by expelling air away from the upstream inlet 14, as shown at arrows 32, as the impeller 22 rotates about the axis of rotation 28. More particularly, the plurality of impeller vanes 26 axially protrudes outwardly from an interior 73 of the volute 12 through the upstream inlet 14 so that rotation of the impeller 22 about the axis of rotation 28 causes the impeller vanes 26 to expel air that collects at the upstream inlet 14 and in other words force the air out of and/or laterally away from the upstream inlet 14.

Figure 2:
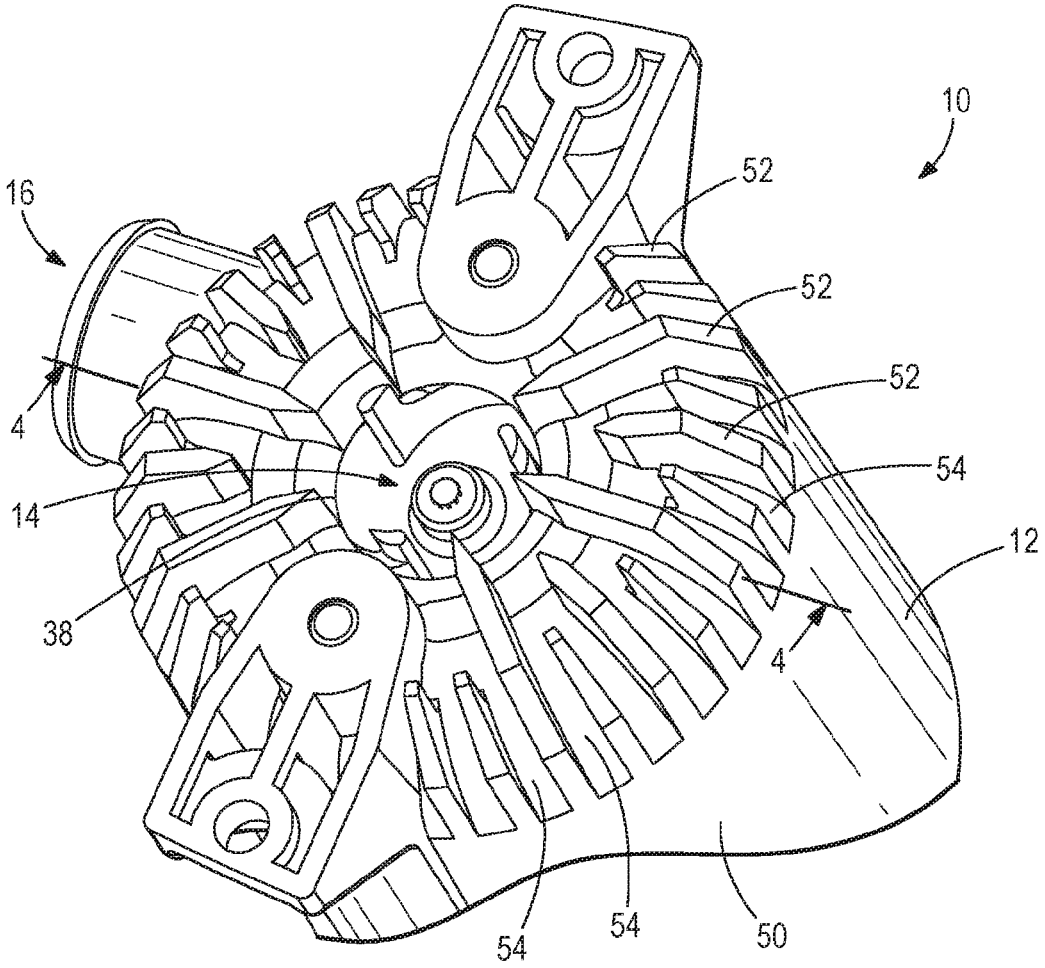
FIG. 2 is a bottom perspective view of the centrifugal pump.
Figure 3:
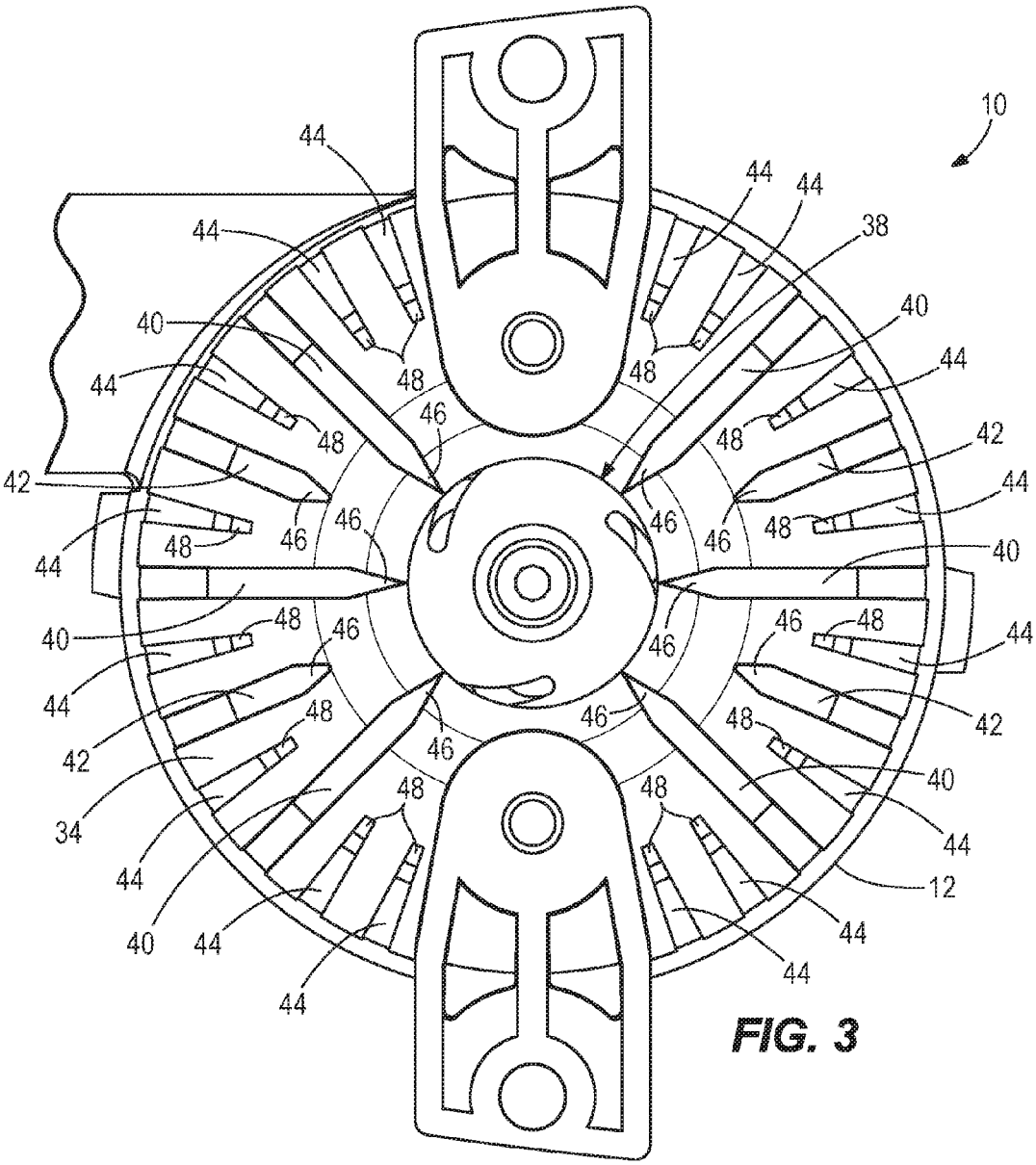
FIG. 3 is a bottom view of a portion of the centrifugal pump.

Referring now to FIGS. 2-5, the volute 12 includes an inlet surface 34, which in this example is a bottom surface, through which the upstream inlet 14 is formed. A plurality of ridges is disposed around and radially extends with respect to the upstream inlet 14 and the axis of rotation 28. The upstream inlet 14 has a perimeter 38 and the ridges are equally spaced apart around the entire perimeter 38. The type and configuration of the ridges can be different from that which is shown and described. As best shown in FIG. 2, the ridges include a first group of ridges 40 and a second group of ridges 42 that are radially shorter than the first group of ridges 40. The second group of ridges 42 is interdigitated amongst the first group of ridges 40. In the illustrated example, the plurality of ridges also includes a third group of ridges 44 that are radially shorter than the second group of ridges 42, as shown in FIG. 2. The third group of ridges 44 is interdigitated amongst the second group of ridges 42 and the first group of ridges 40. In the illustrated example, a ridge from the third group of ridges 44 is disposed between a ridge from the second group of ridges 42 and a ridge from the first group of ridges 40. Some of the ridges have a pointed end 46 that is pointed radially inwardly towards the upstream inlet 14. In the illustrated example, the first and second groups of ridges 40, 42 have the noted pointed end 46. The third group of ridges 44 each have a flat end surface 48 that axially extends with respect to the axis of rotation 28. Advantageously, the spaces between the ridges help split apart the air generated at the upstream inlet 14 by the impeller 22, which improves the speed at which the air is expelled from the upstream inlet 14 along the inlet surface 34. Without these spaces, the air tends to gather at the upstream inlet 14, slowly building up in volume until it breaks the surface tension and releases towards the fluid surface level.

The volute 12 has axially extending sidewalls 50 that together form a generally cylindrical shape. Each of the ridges includes a tapered radially outer end surface 52 that, as shown best in FIGS. 2 and 4, tapers away from the upstream inlet 14 towards the axially extending sidewalls 50. On the inlet surface 34, a plurality of outer volute surfaces 54 are formed between the ridges. Each outer volute surface 54 includes a tapered radially outer end that tapers away from the upstream inlet 14 towards the axially extending sidewalls 50, similar to the tapered radially outer end surfaces 52 of the ridges. In the illustrated example, the tapered radially outer end surfaces 52 of the ridges generally follow the tapered radially outer ends of the outer volute surfaces 54. The amount of and configuration of taper can vary from that which is shown and described. The taper advantageously helps the air to radially move along the inlet surface 34 and then escape upwardly along the sidewalls 50 to the fluid surface level. Another example could be to provide an inlet surface 34 that is curved along its entire surface, rather than flat in certain portions; however this would tend to reduce pump flow performance because the impeller design should match the curve of the volute.

Figure 6:
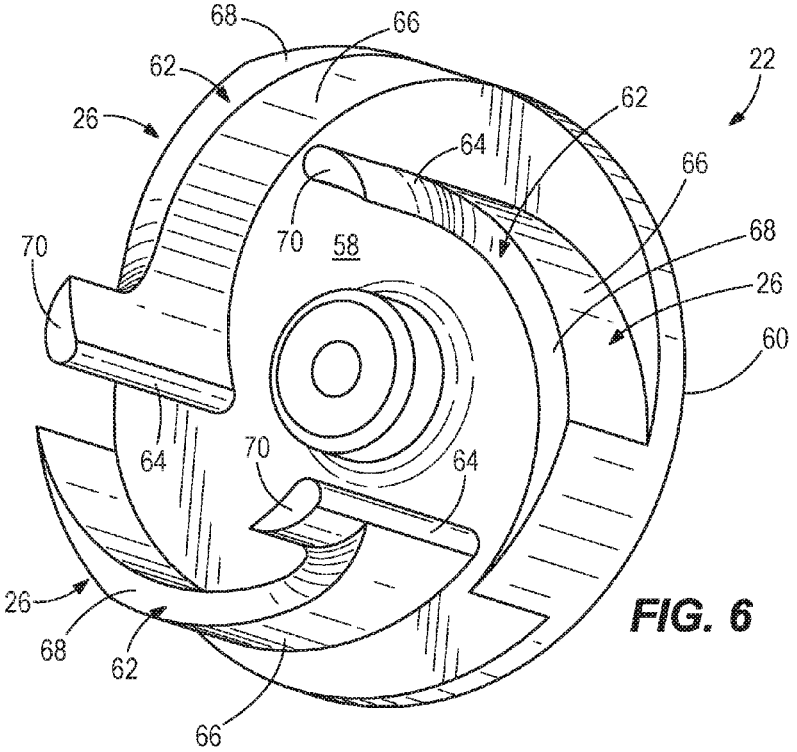
FIG. 6 is a perspective view of an exemplary impeller for the centrifugal pump.
Figure 7:
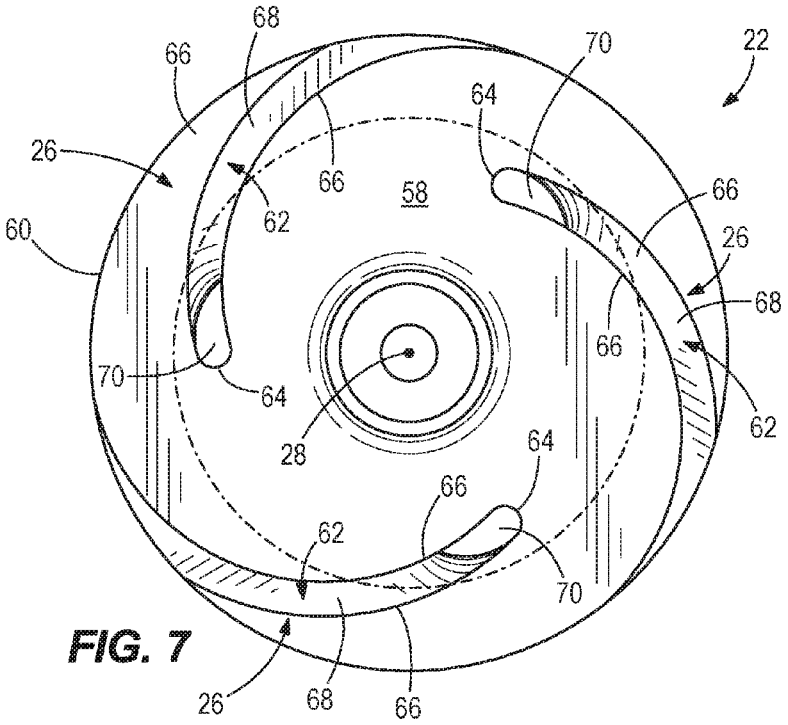
FIG. 7 is a plan view of the impeller.

Referring now to FIGS. 6 and 7, the impeller 22 includes a base 58 that radially inwardly extends from an outer perimeter 60 towards the axis of rotation 28. In the illustrated example, the base 58 is disk-shaped and has a circular shape when viewed in the plan view shown in FIG. 7. The shape and configuration of the base 58 can vary from that shown and described. Each impeller vane 26 is formed by a spiral ridge 62 that curves radially inwardly from the outer perimeter 60 towards the axis of rotation 28 to a radially innermost end 64. Each spiral ridge 62 has axially extending sidewalls 66 that are joined by a top surface 68 that extends along a length of the spiral ridge 62. The sidewalls 66 have a height that increases along the spiral ridge 62 from the outer perimeter 60 towards the radially innermost end 64. The top surface 68 of the spiral ridge 62 is truncated and raised at the radially innermost end 64 to thereby form an aero foil 70 or, in other words, a teardrop-shaped protrusion. The shape and configuration of the impeller vanes 26 can vary from that shown and described.

Referring to FIG. 5, the radially innermost end 64 of the spiral ridge 62 is disposed outside of the interior 73 of the volute 12. In the illustrated example, the upstream inlet 14 includes the perimeter 38. The noted top surface 68 of the spiral ridge 62 and the associated outwardly-directed sidewalls 66 are radially inwardly spaced from the perimeter 38. The outwardly-directed sidewall 66 faces the perimeter 38. By extending through the upstream inlet 14 and being spaced from the perimeter 38, the impeller 22 discourages air-lock by expelling air as it rotates about its axis of rotation 28. The impeller vanes 26 are designed to protrude through the upstream inlet 14 by a measured distance to best enable the noted anti air-lock features. Selecting an appropriate clearance between the impeller vanes 26 and the perimeter 38 of the upstream inlet 14 further impacts the anti air-lock capability.

Figure 1:
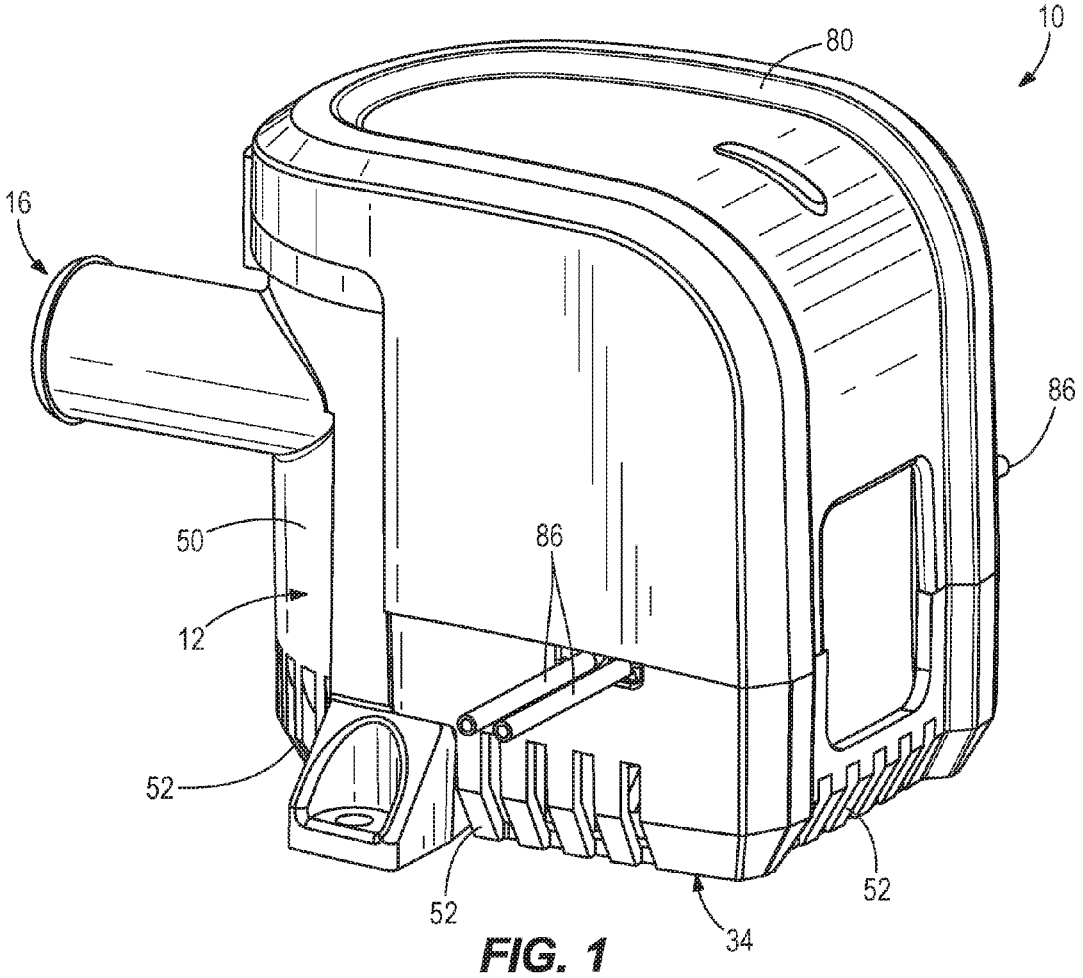
FIG. 1 is a perspective view of an exemplary centrifugal pump for pumping fluid.

Referring to FIGS. 1 and 4, the exemplary centrifugal pump 10 also includes the motor housing 18 that is disposed on the volute 12. In the illustrated example, the motor housing 18 and volute 12 are removably fastened together by a bayonet-style connection 76 that is configured such that twisting of the motor housing 18 with respect to the volute 12 in a first direction allows for separation of the motor housing 18 and volute 12 and twisting of the motor housing 18 in the opposite direction with respect to the volute 12 fastens the motor housing 18 and the volute 12 together. A seal 78, which in this example is a peripheral O-ring seal, peripherally seals between the motor housing 18 and volute 12 in a fluidtight manner. The motor housing 18 retains the motor 20, which as mentioned above drives the impeller 22 into rotation via the spindle shaft 24. A cover 80 is attached to the motor housing 18 and in this example helps retain the motor 20 in place via a center column 82. The configuration of the motor housing 18 and cover 80 is exemplary and can vary from that shown and described.

In the illustrated example, a circuit board 84 and associated on/off switches (not shown) are disposed between the motor housing 18 and cover 80. As shown in FIG. 1, the circuit board 84 receives electricity and/or control signals via electrical wires 86. The circuit board 84 and associated on/off switches can be configured such that when the fluid surface level around the centrifugal pump 10 rises above an upper switch, the circuit board 84 causes the motor 20 to turn on, thus pumping fluid from the upstream inlet 14 to the downstream outlet 16, as described herein above. The circuit board 84 and associated sensors can be configured such that when the fluid surface level is pumped to a level that is lower than a lowermost sensor, the circuit board 84 turns off the motor 20.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. A centrifugal pump for pumping fluid, the centrifugal pump comprising:

a volute having an upstream inlet that receives the fluid and a downstream outlet that discharges the fluid; and an impeller that is disposed in the volute and comprises a plurality of impeller vanes;

wherein the impeller is configured to rotate about an axis of rotation so that the plurality of impeller vanes accelerates the fluid radially outwardly from the upstream inlet to the downstream outlet;

wherein the impeller is further configured to discourage air-lock of the centrifugal pump by expelling air away from the upstream inlet as the impeller rotates about the axis of rotation; and wherein the volute comprises an inlet surface through which the upstream inlet is formed, and further comprising a plurality of ridges that radially extends with respect to the upstream inlet and the axis of rotation.

2. The centrifugal pump according to claim 1, wherein the upstream inlet has a perimeter and wherein the ridges in the plurality of ridges are spaced apart around the perimeter.

3. The centrifugal pump according to claim 2, wherein the plurality of ridges comprises a first group of ridges and a second group of ridges that are radially shorter than the first group of ridges, and wherein the second group of ridges are interdigitated amongst the first group of ridges.

4. The centrifugal pump according to claim 3, wherein the plurality of ridges comprises a third group of ridges that are radially shorter than the second group of ridges, and wherein the third group of ridges are interdigitated amongst the second group of ridges.

5. The centrifugal pump according to claim 2, wherein each ridge in the plurality of ridges comprises a pointed end directed radially inwardly towards the upstream inlet.

6. The centrifugal pump according to claim 2, wherein certain ridges in the plurality of ridges comprise a pointed end directed radially inwardly towards the inlet and wherein certain ridges in the plurality of ridges comprises a flat end surface that axially extends with respect to the axis of rotation.

7. The centrifugal pump according to claim 2, wherein the volute comprises axially extending sidewalls and wherein each of the ridges comprises a tapered radially outer end that tapers away from the upstream inlet towards the axially extending sidewalls.

8. The centrifugal pump according to claim 7, wherein a plurality of outer volute surfaces are formed between the ridges in the plurality of ridges, wherein each outer volute surface in the plurality of outer volute surfaces comprises a tapered radially outer end surface that tapers away from the upstream inlet towards the axially extending sidewalls.

9. The centrifugal pump according to claim 8, wherein the tapered radially outer end surfaces of the ridges are parallel to the tapered radially outer end surfaces of the outer volute surfaces.

10. The centrifugal pump according to claim 9, where each spiral ridge comprises axially extending sidewalls and a top surface that extends along a length of the spiral ridge.

11. The centrifugal pump according to claim 10, wherein the axially extending sidewalls have a height that increases along the spiral ridge from the outer perimeter towards the radially innermost end.

12. The centrifugal pump according to claim 11, wherein the top surface of the spiral ridge is truncated at the radially innermost end to thereby form an aero foil.

13. The centrifugal pump according to claim 12, wherein the radially innermost end of the spiral ridge is disposed outside of the volute.

14. The centrifugal pump according to claim 10, wherein the upstream inlet comprises an outer perimeter and wherein the axially extending sidewalls of the spiral ridge is spaced radially inwardly from and faces the outer perimeter.

15. A centrifugal pump for pumping fluid, the centrifugal pump comprising:

a volute having an upstream inlet that receives the fluid and a downstream outlet that discharges the fluid; and an impeller that is disposed in the volute and comprises a plurality of impeller vanes;

wherein the impeller is configured to rotate about an axis of rotation so that the plurality of impeller vanes accelerates the fluid radially outwardly from the upstream inlet to the downstream outlet;

wherein the impeller is further configured to discourage air-lock of the centrifugal pump by expelling air away from the upstream inlet as the impeller rotates about the axis of rotation; and wherein the impeller comprises a base that radially extends with respect to the axis of rotation from an outer perimeter and wherein each impeller vane in the plurality of impeller vanes comprises a spiral ridge that curves radially inwardly towards the axis of rotation to a radially innermost end of the spiral ridge.

16. The centrifugal pump according to claim 15, wherein the plurality of impeller vanes axially protrudes outwardly from the volute through the upstream inlet so that rotation of the impeller causes the plurality of impeller vanes to expel air that collects at the upstream inlet.

17. The centrifugal pump according to claim 15, further comprising a motor housing on the volute, the motor housing retaining a motor that drives the impeller into rotation.

18. A centrifugal pump for pumping fluid, the centrifugal pump comprising:

a volute having an upstream inlet that receives the fluid and a downstream outlet that discharges the fluid; and an impeller that is disposed in the volute and comprises a plurality of impeller vanes;

wherein the impeller is configured to rotate about an axis of rotation so that the plurality of impeller vanes accelerates the fluid radially outwardly from the upstream inlet to the downstream outlet;

wherein the plurality of vanes axially protrudes outwardly from the volute through the upstream inlet so that rotation of the impeller causes the plurality of impeller vanes to expel air that collects in the volute at the upstream inlet; and wherein the volute comprises an inlet surface through which the inlet is formed, and further comprising a plurality of ridges that radially extend with respect to the inlet and the axis of rotation.

19. The centrifugal pump according to claim 18, wherein the impeller comprises a base that radially extends with respect to the axis of rotation from an outer perimeter towards the axis of rotation; wherein each vane in the plurality of impeller vanes comprises a spiral ridge that curves radially inwardly towards the axis of rotation to a radially innermost end of the spiral ridge; wherein each spiral ridge comprises axially extending sidewalls and a top surface that extends along a length of the spiral ridge; and wherein the upstream inlet comprises an inner perimeter and wherein the top surface of the spiral ridge is spaced radially inwardly from and faces the inner perimeter a distance sufficient to discourage air-lock from occurring.

* * * * *